US007342469B2

(12) United States Patent
Lee et al.

(10) Patent No.: US 7,342,469 B2
(45) Date of Patent: Mar. 11, 2008

(54) AIR CAVITY MODULE FOR PLANAR TYPE FILTER OPERATING IN MILLIMETER-WAVE FREQUENCY BANDS

(75) Inventors: Hong Yeol Lee, Cheongju Chungcheongbuk-do (KR); Dong Suk Jun, Daejeon (KR); Dong Young Kim, Daejeon (KR); Sang Seok Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 101 days.

(21) Appl. No.: 11/150,974

(22) Filed: Jun. 13, 2005

(65) Prior Publication Data

US 2006/0114083 A1 Jun. 1, 2006

(30) Foreign Application Priority Data

Dec. 1, 2004 (KR) ..... 10-2004-0099920

(51) Int. Cl.
*H01P 1/203* (2006.01)

(52) U.S. Cl. ..... 333/204; 333/219

(58) Field of Classification Search ..... 333/204, 333/219

See application file for complete search history.

(56) References Cited

U.S. PATENT DOCUMENTS 5,164,358 A * 11/1992 Buck et al. ..... 333/204
5,798,677 A * 8/1998 Cook ..... 333/204
6,225,878 B1 5/2001 Takahashi et al. ..... 333/204
6,487,427 B1 * 11/2002 Tatekawa et al. ..... 505/210
6,627,966 B2 9/2003 Jeong et al. ..... 333/193 X
6,741,142 B1 * 5/2004 Okazaki et al. ..... 333/99 S
6,771,147 B2 * 8/2004 Mongia ..... 333/204

OTHER PUBLICATIONS

"Packaging Using Microelectromechanical Technologies and Planar Components" Takahashi et al., IEEE Transactions On Microwave Theory and Techniques, vol. 49, No. 11, Nov. 2001, pp. 2099-2104.

* cited by examiner

*Primary Examiner*—Benny Lee
(74) *Attorney, Agent, or Firm*—Ladas & Parry LLP

(57) ABSTRACT

Provided is an air cavity module for a planar type filter operating in millimeter-wave frequency bands. The air cavity module includes: the planar type filter operating in the millimeter frequency bands; an air cavity having open side and top surfaces to mount the planar type filter therein; and an air cavity cover closing up the open top surface of the air cavity to allow the transmission of signals from and into the planar type filter. The air cavity module can lessen both transmission loss and radiation loss to improve the characteristics of the filter that operates in the millimeter-wave frequency bands.

8 Claims, 3 Drawing Sheets

AIR CAVITY MODULE FOR PLANAR TYPE FILTER OPERATING IN MILLIMETER-WAVE FREQUENCY BANDS

CROSS-REFERENCE TO RELATED APPLICATION

This application claims priority to and the benefit of Korean Patent Application No. 2004-99920, filed Dec. 1, 2004, the disclosure of which is incorporated herein by reference in its entirety.

BACKGROUND

1. Field of the Invention

The present invention relates to an air cavity module for a planar type filter operating in millimeter-wave frequency bands and, more specifically, to an air cavity module for a planar type filter operating in millimeter-wave frequency bands, in which cavity resonance is eliminated from an air cavity for a planar type filter and the planar type filter is completely mounted in the air cavity, so that both transmission loss and radiation loss can be reduced to improve the characteristics of the filter that operates in the millimeter-wave frequency bands.

2. Discussion of Related Art

In general, as the development of wireless communication technology has been accelerated and the amount of processed data has increased, the operating frequency of wireless, communication systems has been spontaneously reaching millimeter-wave frequency bands on the order of several tens of GHz or higher. In this connection, components for the wireless communication systems have been scaled down in size, and above all, a radio frequency (RF) filter, which is a passive component, has been scaled down to such a small size that it can be made using a semiconductor process.

Also, as the operating frequency of the wireless communication systems becomes higher and the RF filter becomes smaller, the RF filter is more susceptible to the environment and may be seriously damaged due to radiation loss.

It is difficult to find an exemplary conventional technique of an air cavity for a planar type filter that operates in the frequency band on the order of several tens of GHz or higher because the technique is not yet generalized. However, there is a disclosure having similar objects, which is directed to a ceramic package for a surface acoustic wave (SAW) filter that operates in low frequency bands. In the disclosure, a filter is mounted in the ceramic package, and an electrode of the filter and an electrode of a ceramic module are connected using a wire bonding process, thereby enabling the transmission of signals.

The above-described ceramic package is aimed at protecting components against external shock and, particularly, protecting the SAW filter, which is susceptible to the environment, by cutting off externally generated electromagnetic waves.

However, once the operating frequency of the SAW filter exceeds several tens of GHz, the SAW filter may be damaged, the bonded wire itself may operate as a parasitic factor, and transmission loss may increase.

As another similar example, there is a receiver for a wireless communication system that operates in the frequency band of 20 GHz. The receiver for the wireless communication system is formed as a system on packaging (SOP) type on a multilayered benzocyclobutene (BCB) layer formed on a silicon substrate.

In this case, components as active devices are bonded as a flip-chip onto the BCB layer. A dual mode resonator (DMR) pattern is printed as an inverted microstrip line (IMSL) on the BCB layer, and a planar type fitter as a passive device is covered by and bonded to a cavity, which is obtained by etching the surface of the silicon substrate to a shallow depth using a dry etching process and covering the etched surface with a metal.

Because all the components are mounted on the line printed on the same substrate, interconnection loss between the components may be reduced. Also, the cavity formed in the silicon substrate covers the planar type filter so that transmission loss may be lessened.

However, since the planar type filter is not completely mounted in the cavity, signals are leaked through the silicon substrate on which the BCB layer is formed, thus resulting in great transmission loss and poor attenuation characteristics.

SUMMARY OF THE INVENTION

The present invention is directed to an air cavity module for a planar type filter operating in millimeter-wave frequency bands, in which cavity resonance is eliminated from an air cavity for a planar type filter and the planar type filter is completely mounted in the air cavity, so that both transmission loss and radiation loss can be reduced to improve the characteristics of the filter that operates in millimeter-wave frequency bands.

One aspect of the present invention is to provide an air cavity module for a planar type filter operating in millimeter-wave frequency bands, which includes: the planar type filter operating in the millimeter frequency bands; an air cavity having open side and top surfaces to mount the planar type filter therein; and an air cavity cover closing up the open top surface of the air cavity to allow the transmission of signals from and into the planar type filter.

The planar type filter may be one of a coplanar waveguide (CPW) type planar filter and a microstrip line (MSL) type planar filter.

The air cavity may have a square box shape with both side surfaces and a top surface open.

A first hole and a second hole may be formed in both edge portions of the air cavity cover, respectively. Here, the first hole allows the inputting of an electric signal into the planar type filter and the second hole allows the detecting of an electric signal output from the planar type filter.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EXEMPLARY EMBODIMENTS

The present invention will now be described more fully hereinafter with reference to the accompanying drawings, in which exemplary embodiments of the invention are shown. This invention may, however, be embodied in different forms and should not be construed as limited to the embodiments set forth herein. Rather, these embodiments are provided so that this disclosure is thorough and complete and fully conveys the scope of the invention to those skilled in the art.

Figure 1:
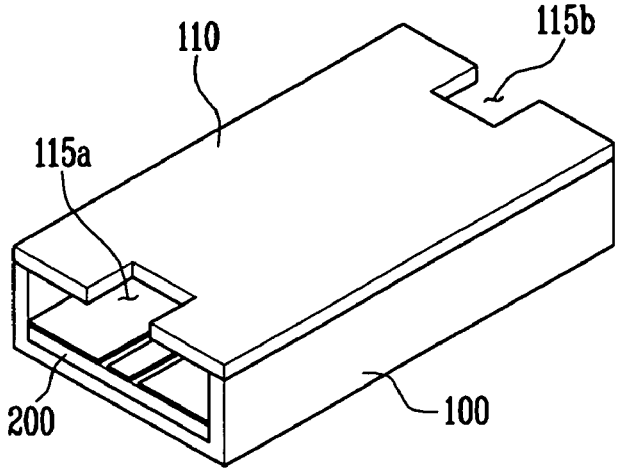
FIG. 1 is a construction diagram of an air cavity module for a planar type filter operating in millimeter-wave frequency bands according to an exemplary embodiment of the present invention.
Figure 2:
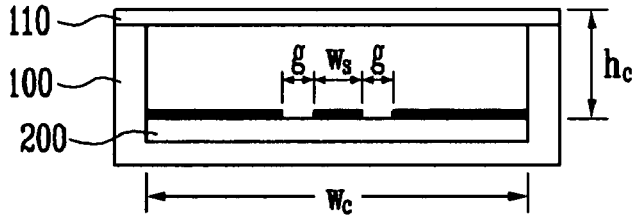
FIG. 2 is a front view of the air cavity module shown in FIG. 1.
Figure 3:
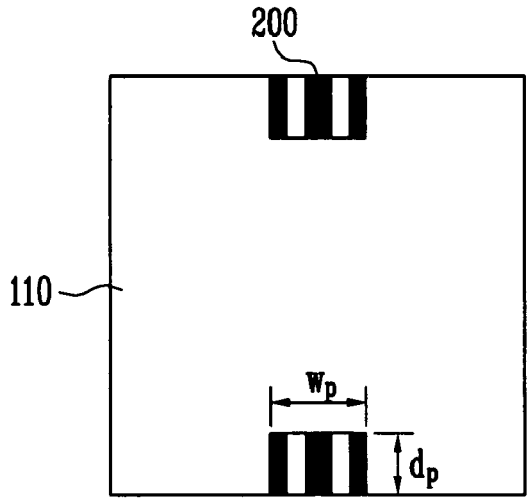
FIG. 3 is a plan view of the air cavity module shown in FIG. 1.

FIG. 1 is a construction diagram of an air cavity module for a planar type filter operating in millimeter-wave frequency bands according to an exemplary embodiment of the present invention, and FIGS. 2 and 3 are a front view and a plan view of the air cavity module shown in FIG. 1, respectively.

Referring to FIGS. 1 through 3, the air cavity module for the planar type filter operating in millimeter-wave frequency bands includes an air cavity 100 (FIGS. 1-2), an air cavity cover 110, and a planar type filter 200 that operates in millimeter-wave frequency bands.

Specifically, in the air cavity module for the planar type filter operating in the millimeter-wave frequency bands according to the present invention, the planar type filter 200 is mounted in the air cavity 100, and the air cavity 100 is covered by and bonded to the air cavity cover 110.

In this case, the air cavity 100 may have a square box shape with both side surfaces and a top surface open such that the planar type filter 200 is easily mounted therein.

The air cavity cover 110 may close up the top surface of the air cavity 100 so as to enable the transmission of signals from and into the planar type filter 200.

In other words as seen in FIG. 1, a first hole 115*a* and a second hole 115*b* are formed in both edge portions of the air cavity cover 110, respectively. The first hole 115*a* is used to input an electric signal into the planar type filter 200, whereas the second hole 115*b* is used to detect an electric signal output from the planar type filter 200.

Figure 6:
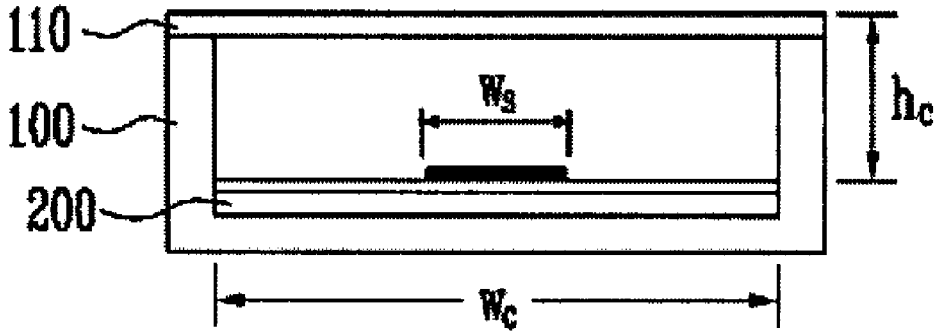
FIG. 6 is a front view of the air cavity module shown in FIG. 1 having a microstrip line type filter.

The planar type filter 200 may be one of a coplanar waveguide (CPW) type filter as depicted in FIG. 2 and a microstrip line (MSL) type filter as depicted in FIG. 6. Also, if the planar type filter 200 is the CPW type filter, it may be one of a grounded CPW type filter and an ungrounded CPW type filter.

Referring to FIGS. 2 and 6, when $w_c$ refers to the width of the air cavity 100 and $h_c$ refers to the height of the air cavity 100, which corresponds to a distance between the planar type filter 200 and the air cavity cover 10, they can be obtained within the following ranges to eliminate cavity resonance and lessen radiation loss:

$w_c \geqq 3(2g+w_s)$; in the case of a CPW type filter of FIG. 2

$w_c \geqq 5w_s$; in the case of an MSL type filter $0.25\lambda g \leqq h_c \leqq 0.5$ kg, where $w_s$ is the width of a signal line of the planar type filter 200, and g is a distance between the signal line and a ground plane in the planar type filter 200.

The first and second holes 115*a* and 115*b* of the air cavity cover 110 make the air cavity 100 open in the vertical direction and enable measurements and a wire bonding process, and each of them has a width w.sub.p and a depth $d_p$ as seen in FIG. 3. Here, $w_p$ should be sufficient to put a probe for measurements or a wire for wire bonding into the air cavity 200, and $d_p$ should be not more than ¼the guided wavelength.

Figure 4:
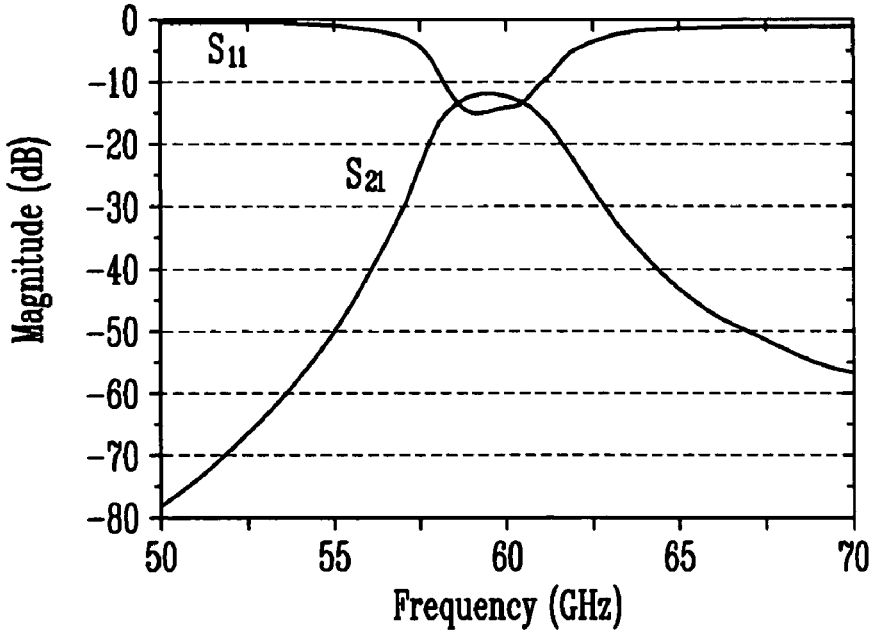
FIG. 4 is a graph of simulation results showing the frequency response characteristics of a planar type filter without the air cavity module of FIG. 1.

FIG. 4 is a graph of simulation results showing the frequency response characteristics of the planar type filter 200 without the air cavity module of FIG. 1.

Referring to FIG. 4, the planar type filter 200 was designed as a CPW type 4-pole bandpass filter having a center frequency of about 60 GHz. From the standpoint of frequency response characteristics, a curve $S_{11}$ does not exceed 15 dB at 60 GHz, and a curve $S_{21}$ exhibits a greater transmission loss than 10 dB at 60 GHz. Since the curves $S_{11}$ *and* $S_{21}$ are generally gentle, it can be interpreted that the frequency response characteristics of the filter 200 are affected by radiation loss.

Figure 5:
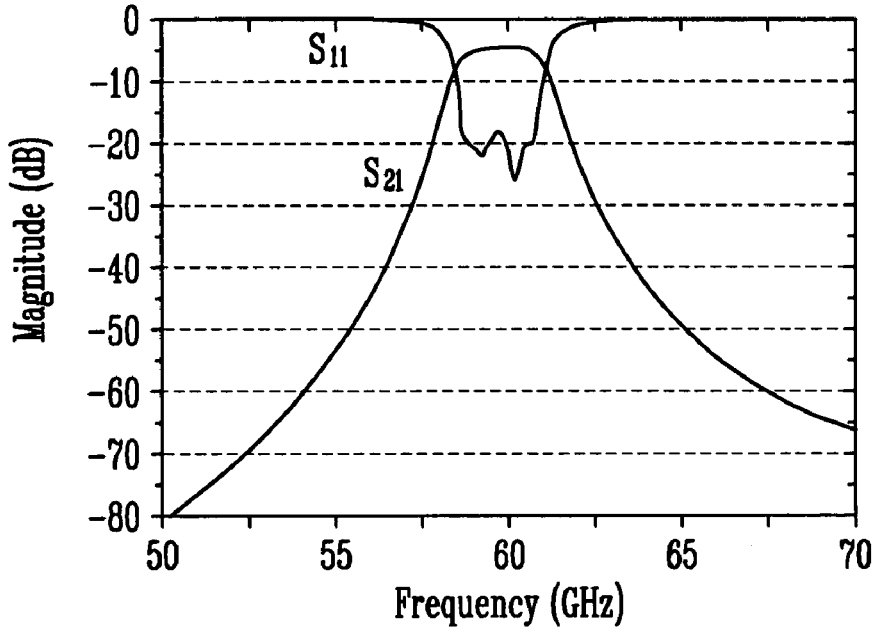
FIG. 5 is a graph of simulation results showing the frequency response characteristics of a planar type filter with the air cavity module of FIG. 1.

FIG. 5 is a graph of simulation results showing the frequency response characteristics of the planar type filter 200 with the air cavity module of FIG. 1.

Referring to FIG. 5, the simulation was conducted using the planar type filter 200, which includes the air cavity 100 having a width $w_c$ of 0.7 mm and a height $h_c$ of 0.5 mm and the hole having a width $w_p$ of 0.4 mm and a depth $d_p$ of 0.5 mm. A curve $S_{11}$ approximates to 20 dB at about 60±2 GHz, and a curve $S_{21}$ reaches 4 dB or less at about 60±2 GHz. That is, the filter 200 has excellent frequency response characteristics.

From the simulation results shown in FIGS. 4 and 5, it can be confirmed that the air cavity module according to the exemplary embodiment of the present invention can notably reduce the transmission loss and radiation loss.

As described above, in the air cavity module for a planar type filter operating in millimeter-wave frequency bands according to the present invention, cavity resonance is eliminated from an air cavity for a planar type filter and the planar type filter is completely mounted in the air cavity. Hence, both transmission loss and radiation loss can be lessened to improve the characteristics of the filter that operates in the millimeter-wave frequency bands.

Although exemplary embodiments of the present invention have been described with reference to the attached drawings, the present invention is not limited to these embodiments, and it should be appreciated to those skilled in the art that a variety of modifications and changes can be made without departing from the spirit and scope of the present invention.

What is claimed is:

1. An air cavity module for a planar filter operating in millimeter-wave frequency bands, comprising:

a filter operating in the millimeter frequency bands, wherein the filter has a first filter end for receiving or outputting an electrical signal;

an air cavity having entirely open side and top surfaces to mount the filter therein; and an air cavity cover, having an open ended first cover rectangular recess, closing up the top surface of the air cavity except the area exposed due to the open ended first cover recess to allow the transmission of signals from and into the filter, wherein the open ended first cover rectangular recess is located at an edge of the air cavity cover to expose a portion of the first filter end through the top surface of the air cavity, wherein the open ended first cover rectangular recess has a depth dp and an width wp, and wherein the open ended first cover rectangular recess allows insertion of a measurement probe or a wire for wire bonding into the air cavity, and the depth dp is not more than ¼ of the wavelength of the electrical signal, said electrical signal guided by the air cavity module.

2. The air cavity module according to claim 1, wherein the planar filter is one of a coplanar waveguide (CPW) planar filter and a microstrip line (MSL) planar filter.

3. The air cavity module according to claim 1, wherein the air cavity has a square box shape with both side surfaces and a top surface open.

4. The air cavity module according to claim 1, wherein respective expressions wc>=3(2g+ws) and 0.25λg<=hc<=0.5 λg provide for a CPW filter eliminating cavity resonance and lessening radiation loss wherein:

wc is the width of the air cavity;

ws is the width of the portion of the first filter end;

g is a gap such that wp=ws+2 g;

hc is the height of the air cavity; and

λg is the wavelength of the signal guided by the air cavity module.

5. The air cavity module according to claim 1, wherein the filter has a second filter end for receiving or outputting an electrical signal, and wherein the air cavity cover, has an open ended second cover recess' closing up the top surface of the air cavity except the area exposed due to the open ended first cover recess to allow the transmission of signals from and into the filter, wherein the open ended second cover recess is located at an edge of the air cavity cover to expose a portion of the second filter end through the top surface of the air cavity.

6. The air cavity module according to claim 5, wherein the second recess is rectangular having a depth dp and an width wp.

7. The air cavity module according to claim 6, wherein the second recess allow insertion of a measurement probe or a wire for wire bonding into the air cavity, and the depth dp is not more than ¼of the wavelength of the electrical signal, said electrical signal guided by the air cavity module.

8. The air cavity module according to claim 6, wherein respective expressions wc>=3(2g+ws) and 0.25 λg<=hc<=0.5 μg provide for a CPW filter eliminating cavity resonance and lessening radiation loss wherein:

wc is the width of the air cavity;

ws is the width of the portion of the second filter end;

g is a gap such that wp=ws+2g;

hc is the height of the air cavity; and

λg is the wavelength of the signal guided by the air cavity module.

* * * * *